US012589270B2

(12) United States Patent
Hsu et al.

(10) Patent No.: US 12,589,270 B2
(45) Date of Patent: Mar. 31, 2026

(54) EXERCISE DEVICE

(71) Applicant: Fitness Authority Industrial CO., LTD., Taichung City (TW)

(72) Inventors: You-Hsiang Hsu, Taichung City (TW); Randal L. Lundquist, Ontario, OH (US)

(73) Assignee: Fitness Authority Industrial CO., LTD., Taichung City (TW)

( * ) Notice: Subject to any disclaimer, the term of this patent is extended or adjusted under 35 U.S.C. 154(b) by 134 days.

(21) Appl. No.: 18/602,647

(22) Filed: Mar. 12, 2024

(65) Prior Publication Data

US 2025/0288844 A1 Sep. 18, 2025

(51) Int. Cl.
*A63B 21/00* (2006.01)

(52) U.S. Cl.
CPC .... *A63B 21/00069* (2013.01); *A63B 21/4029* (2015.10); *A63B 21/4033* (2015.10)

(58) Field of Classification Search
CPC ..... A63B 21/00069; A63B 21/4029; A63B 21/4033
See application file for complete search history.

(56) References Cited

U.S. PATENT DOCUMENTS 4,561,651 A * 12/1985 Hole ..... A63B 21/06 482/102
5,236,406 A * 8/1993 Webber ..... A63B 21/4047 482/99
5,330,405 A * 7/1994 Habing ..... A63B 21/0616 482/137
6,689,023 B2 * 2/2004 Baumler ..... A63B 21/0628 482/137
D513,286 S * 12/2005 Panatta ..... D21/676
7,223,213 B2 * 5/2007 Golesh ..... A63B 21/159 482/145
7,322,906 B2 * 1/2008 Webber ..... A63B 21/4047 482/137
7,922,629 B1 * 4/2011 Batca ..... A63B 23/1263 482/92
7,998,036 B2 * 8/2011 Ish, III ..... A63B 21/0628 482/93
2005/0272573 A1 * 12/2005 Carter ..... A63B 23/0355 482/99

* cited by examiner

*Primary Examiner* — Andrew M Kobylarz
(74) *Attorney, Agent, or Firm* — Muncy, Geissler, Olds & Lowe, P.C.

(57) ABSTRACT

An exercise device is provided, wherein the exercise device includes: a adjustable weight unit; a first training mechanism including two supports defining an internal space and a height direction, first rollers disposed on the two supports, two first cables, and two pulling assemblies disposed on the two supports and movable in the height direction, the two first cables being respectively disposed around the first rollers and connected to the adjustable weight unit and the two pulling assemblies; and a second training mechanism including a base received in the internal space, a swingable assembly disposed on the base, second rollers disposed on the base, and a second cable disposed around the second rollers and connected to the adjustable weight unit and the swingable assembly.

7 Claims, 7 Drawing Sheets

EXERCISE DEVICE

BACKGROUND OF THE INVENTION

Field of the Invention

The present invention relates to an exercise device.

Description of the Prior Art

As people put more and more emphasis on physical health, exercise has become a very important discipline for modern people. However, due to the crowded environment and poor air quality of the urban area, people tend to exercise indoors at home, for example, using exercise devices in a gym to conduct weight training, to maintain physical health and fitness. A conventional exercise device includes a frame body, a pulling mechanism and an adjustable weight mechanism, the pulling mechanism and the adjustable weight mechanism are connected through the cooperation of a cable and a roller set. When a user grasps a pulling member of the pulling mechanism, s/he needs to overcome the weight set on the adjustable weight mechanism to pull the pulling member and to train.

The conventional exercise device just has limited mobility, so the exercise device can only be used to perform specific exercises. When the user wants to perform additional exercises, he/she needs to use other types of exercise devices, so it is inconvenient and costly.

The present invention is, therefore, arisen to obviate or at least mitigate the above-mentioned disadvantages.

SUMMARY OF THE INVENTION

The main object of the present invention is to provide an exercise device which can be used for multi-functional and multi-angle training, so users can use the exercise device to perform different exercises and save the cost and space of placing exercise equipment.

To achieve the above and other objects, an exercise device is provided, wherein the exercise device includes: an adjustable weight unit; a first training mechanism including two supports, a plurality of first rollers, two first cables and two pulling assemblies, the two supports defining an internal space, the two supports defining a height direction, the two pulling assemblies being disposed on the two supports and movable up or down, the plurality of first rollers being disposed on the two supports, the two first cables being respectively disposed around the plurality of first rollers and connected to the adjustable weight unit and the two pulling assemblies so that the two pulling assemblies and the adjustable weight unit are movable with each other; linked to a second training mechanism including a base, a swingable assembly, a plurality of second rollers and a second cable, the base being received in the internal space, the swingable assembly being disposed on the base, the plurality of second rollers being disposed on the base, the second cable being disposed around the plurality of second rollers and connected to the adjustable weight unit and the swingable assembly so that the swingable assembly and the adjustable weight unit are movable with each other.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
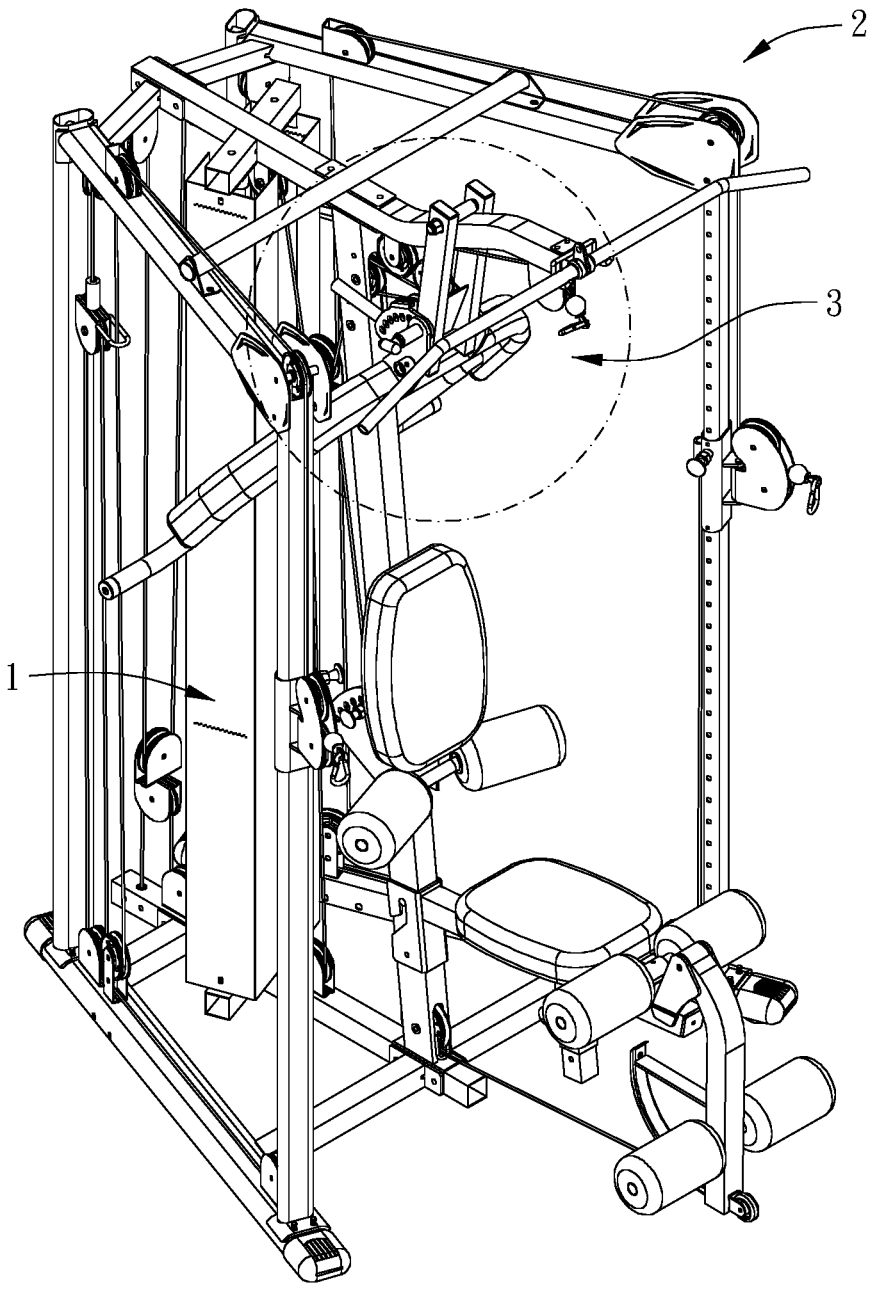
FIG. 1 is a stereogram of an exemplary embodiment of the present invention.
Figure 2:
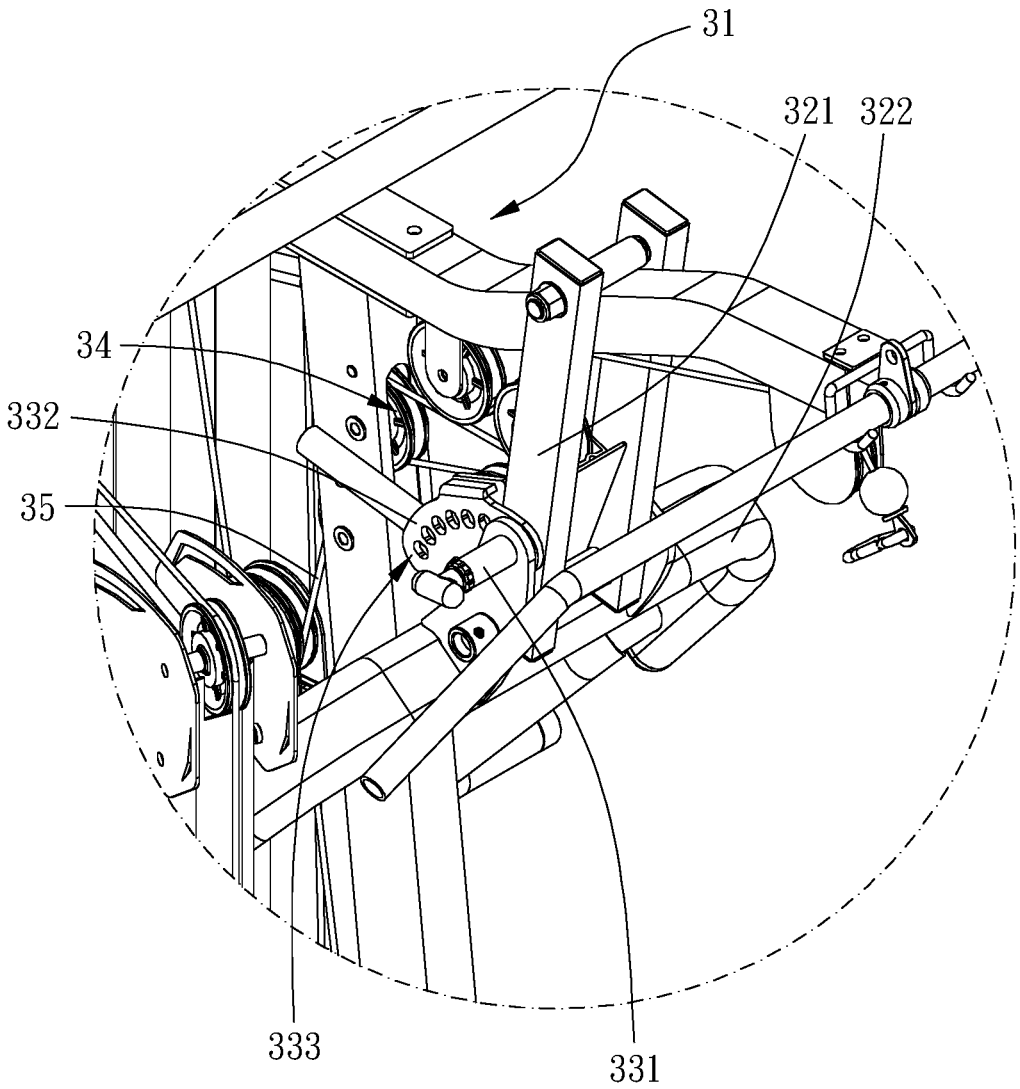
FIG. 2 is a partial enlarged view of FIG. 1.
Figure 3:
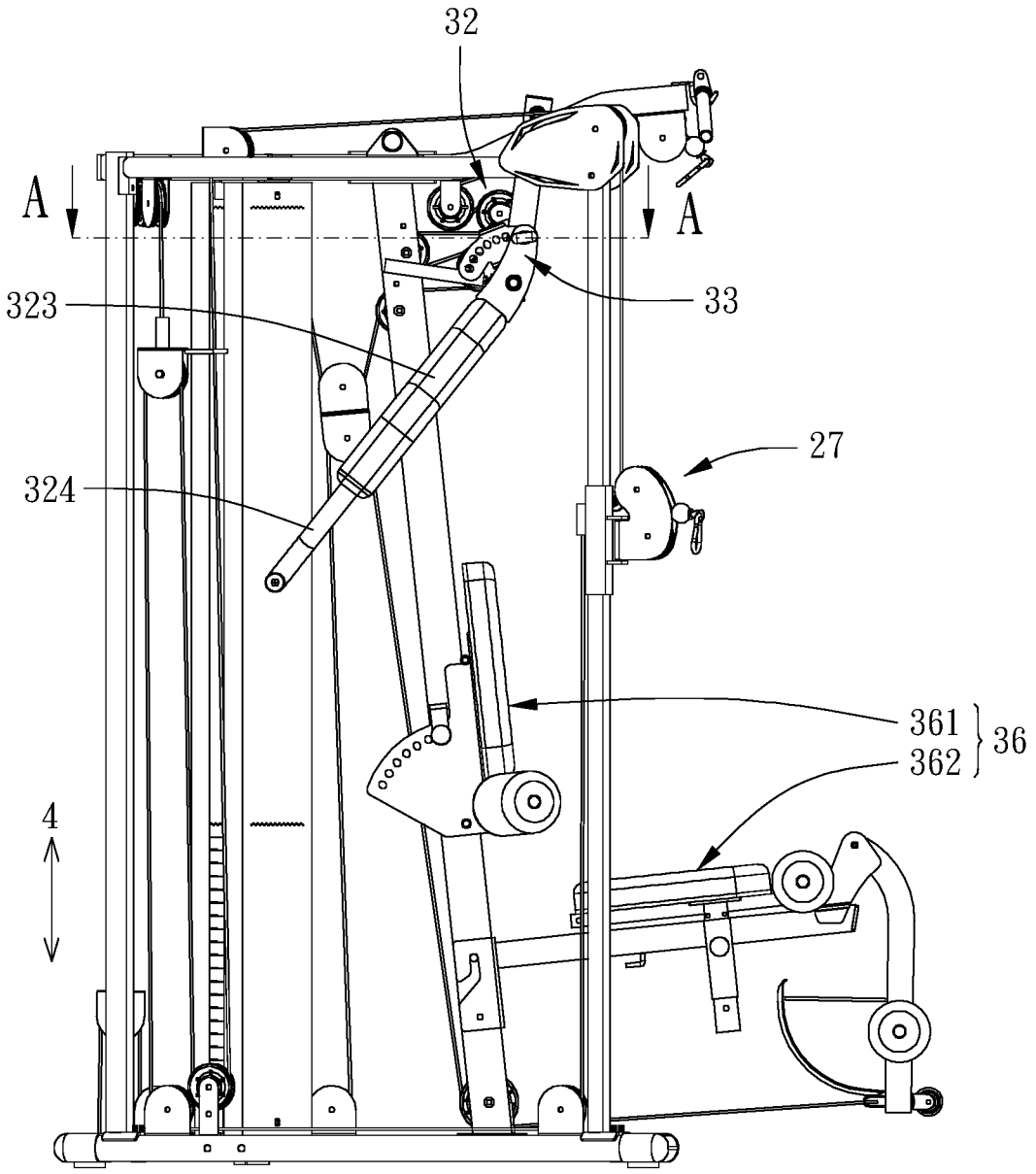
FIG. 3 is a side view of FIG. 1.
Figure 4:
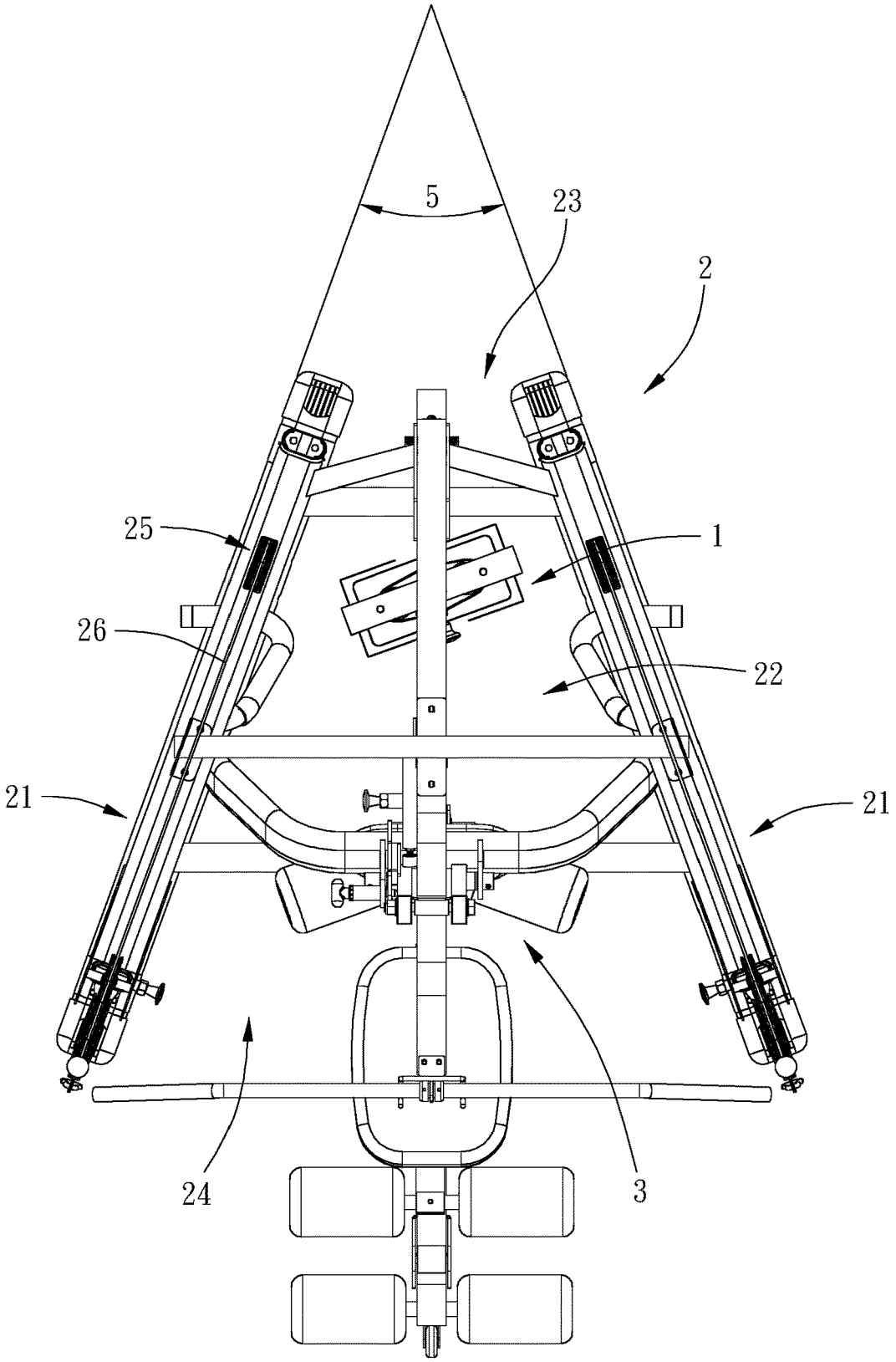
FIG. 4 is a top view of FIG. 1.

Please refer to FIGS. 1 to 7 for an exemplary embodiment of the present invention. An exercise device 1 of the present invention includes a adjustable weight unit 1, a first training mechanism 2 and a second training mechanism 3 all linked to become one machine.

The first training mechanism 2 includes two supports 21, a plurality of first rollers 25, two first cables 26 and two pulling assemblies 27, the two supports 21 define an internal space 22, the two supports 21 define a height direction 4, the two pulling assemblies 27 are disposed on the two supports 21 and movable up or down, the plurality of first rollers 25 are disposed on the two supports 21, and the two first cables 26 are respectively disposed around the plurality of first rollers 25 and connected to the adjustable weight unit 1 and the two pulling assemblies 27 so that the two pulling assemblies 27 and the adjustable weight unit 1 are movable with each other. The second training mechanism 3 includes a base 31, a swingable assembly 32, a plurality of second rollers 34 and a second cable 35, the base 31 is received in the internal space 22, the swingable assembly 32 is disposed on the base 31, the plurality of second rollers 34 are disposed on the base 31, the second cable 35 are disposed around the plurality of second rollers 34 and connected to the adjustable weight unit 1 and the swingable assembly 32 so that the swingable assembly 32 and the adjustable weight unit 1 are movable with each other.

The exercise device can provide two different training mechanisms for trainers to choose from, which can effectively save storage space and purchase costs. The first training mechanism 2 may be called a functional training mechanism, and it can fully train the muscles of the trainer. The trainer can stand in front of the two supports 21 and pull the two pulling assemblies 27 with one or both hands to exercise the upper body, or with the feet attached to the pulling assembly 27 through the leggings to train the lower body both without a pre-defined motion. The second training mechanism 3 may be called a press training mechanism, and it focuses on training the pectoralis major, anterior deltoid muscles, triceps, back muscles, etc., which can make the chest strong and improve the hunchback.

Specifically, the adjustable weight unit 1 is located in the internal space 22 and disposed on the base 31, ensuring that the weight block of the adjustable weight unit 1 moves smoothly without being interfered by foreign objects, and can fully utilize the internal space 22. The two supports 21 are located on opposing sides of the base 31. As viewed in the height direction 4, the two supports 21 is in an arced arrangement so that it is conducive to reducing the space required for display and maintaining enough space for trainers.

The swingable assembly 32 includes a swingable member 321 and a grip 322, the swingable member 321 is disposed on the base 31 and connected to the second cable 35, and the grip 322 is adjustably positioned to the swingable member 321 so that trainers can adjust the relative positions of the grip 322 and the swingable member 321 according to their body shape or height. The swingable assembly 32 further includes a positioning mechanism 33, the positioning mechanism 33 includes a first positioning mechanism 331 and a plurality of positioning holes 333, one of the first positioning mechanism 331 and the plurality of positioning holes 333 is disposed on the grip 322, the other of the first positioning mechanism 331 and the plurality of positioning holes 333 is disposed on the swingable member 321, and the first positioning mechanism 331 is selectively inserted in one of the plurality of positioning holes 333. In this embodiment, the positioning mechanism 33 further includes a first adjustment disc 332, the first adjustment disc 332 is disposed on the swingable member 321 and includes the plurality of positioning holes 333, and the plurality of positioning holes 333 are arranged in intervals in a arced arrangement. The first positioning mechanism 331 includes a tubular portion 334, an elastic member 335 and a pin 336, the tubular portion 334 is positioned to the grip 322, the pin 336 is movably disposed through the tubular portion 334, the elastic member 335 is disposed between an inner surface of the tubular portion 334 and the pin 336, and the pin 336 is biased by the elastic member 335, protrusive out beyond the tubular portion 334 and inserted in one of the plurality of positioning holes 333. Trainers can perform different weight training by facing the grip 322 in different directions and in different positions.

Figure 6:
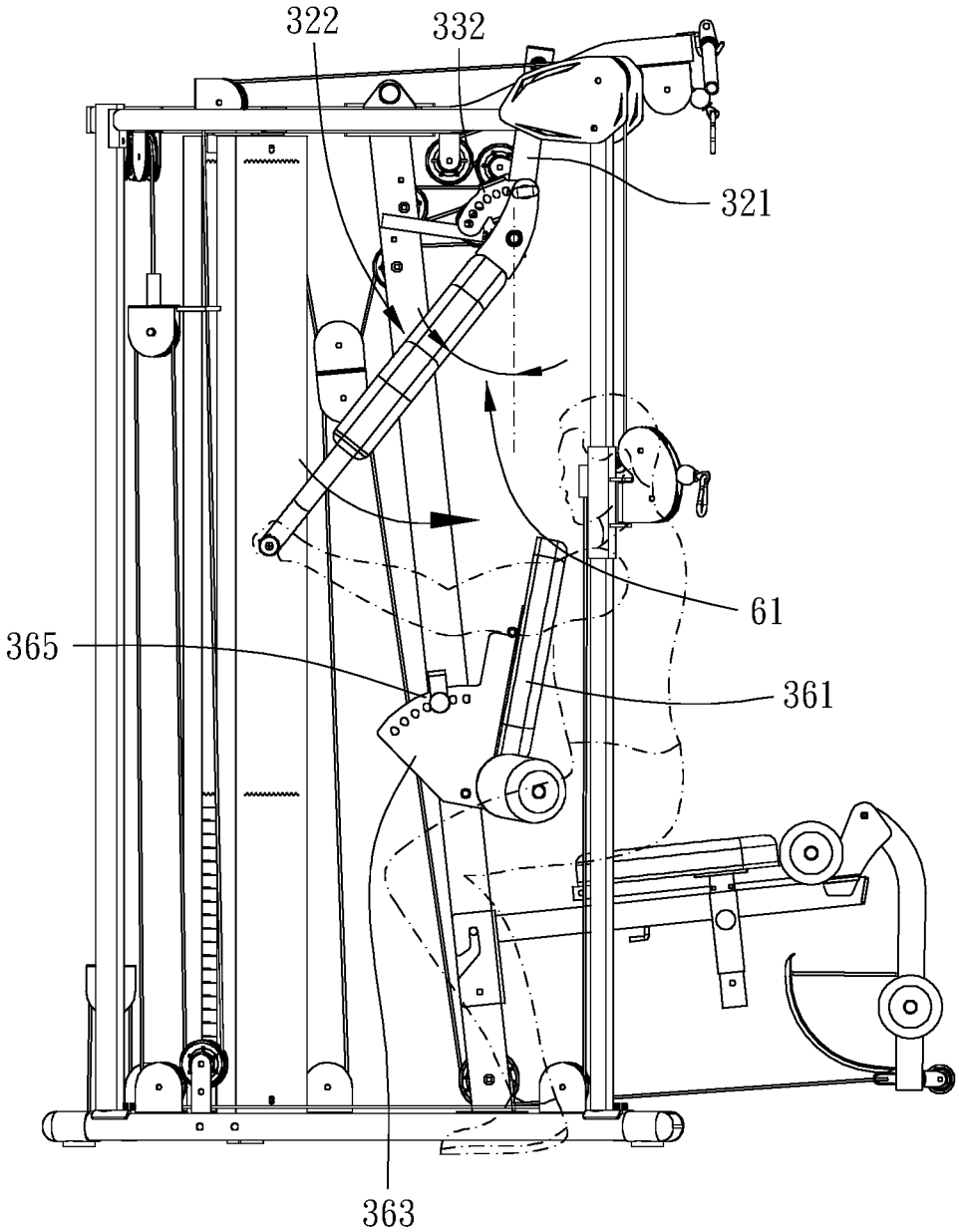
FIG. 6 is a drawing showing rowing training according to an exemplary embodiment of the present invention.
Figure 7:
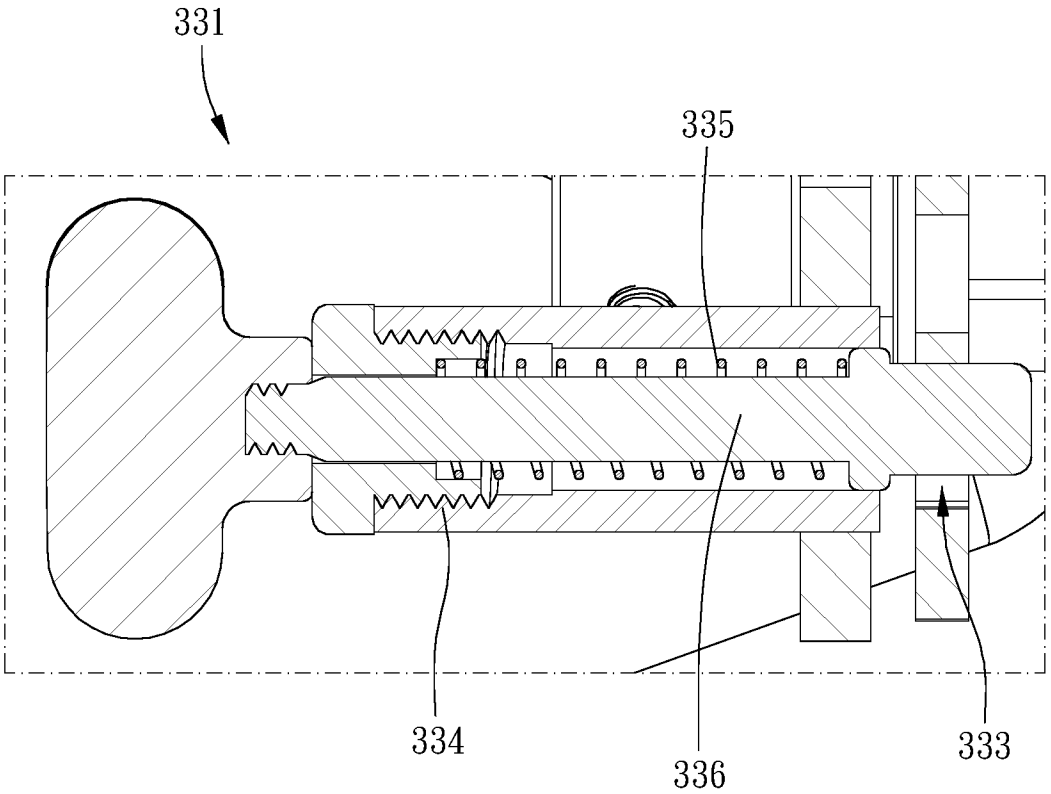
FIG. 7 is a partial enlarged cross-sectional view of an exemplary embodiment of the present invention.

Specifically, an end of the grip 322 is positioned to a right end of the first adjustment disc 332, and when the trainer faces the adjustable weight unit 1 and the grip 322 is adjusted to be between the adjustable weight unit 1 and the trainer, for example, as shown in FIG. 6, in this mode, the trainer can simulate rowing movements to train back muscles. Preferably, the swinging range of the grip 322 is within the internal space 22, which can avoid unexpected collisions between the grip 322 and people and things located outside the internal space 22 during actual use, especially those that are invisible to the user.

Figure 5:
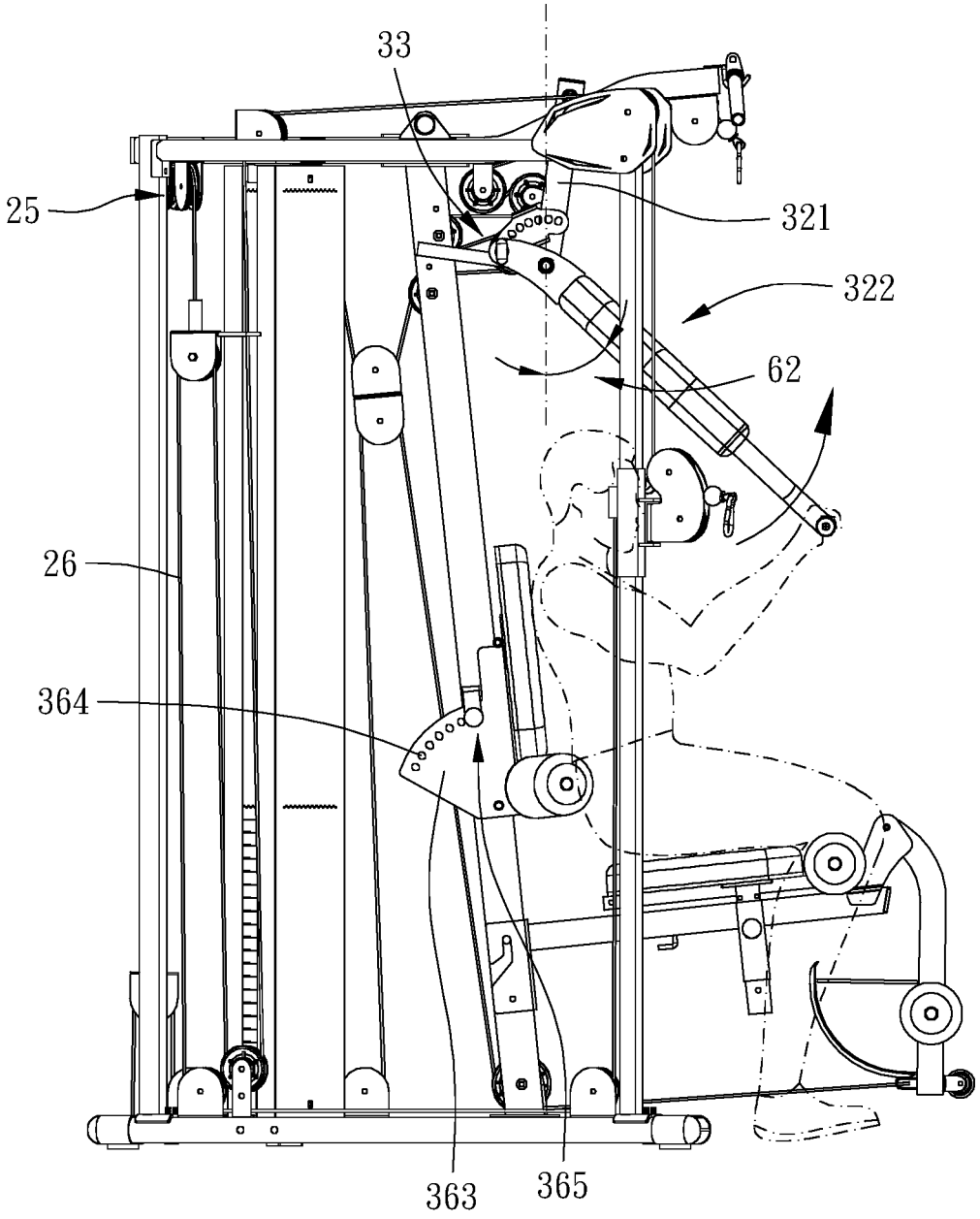
FIG. 5 is a drawing showing chest press training according to an exemplary embodiment of the present invention.

An end of the grip 322 is positioned to a left end of the first adjustment disc 332, a portion of the grip 322 is protrusive beyond the two supports 21 in a direction perpendicular to the height direction 4, and when the trainer faces away from the adjustable weight unit 1 and the trainer is between the adjustable weight unit 1 and the grip 322, for example, as shown in FIG. 5, in this mode, trainers can simulate lifting and pressing movements to train chest muscles. When not operated, the second included angle 62 is larger than the first included angle 61. The grip 322 may be swung from the outside of the internal space 22 to be within the internal space 22.

The second training mechanism 3 further includes a seating portion 36 which is replaceable by a fitness bench (such as flat, incline or decline bench), so that trainers can perform training in a chair-sitting position, which provides better movement stability.

Specifically, the seating portion 36 includes a back 361 and a seat 362, the back 361 is positioned to the base 31, and the seat 362 is disposed on and protrusive from the base 31. When operating the second training mechanism 3, trainers can adjust the position of the back 361 to properly support the chest or back. In this embodiment, the seating portion 36 further includes a second adjustment disc 363 and a second positioning mechanism 365, the second adjustment disc 363 is disposed on and movable with the back 361, the second adjustment disc 363 includes a plurality of insertion holes 364, and the second positioning mechanism 365 is disposed on the base 31 and selectively inserted in one of the plurality of insertion holes 364 to position the back 361. The second positioning mechanism 365 may be identical to the first positioning mechanism 331. Specifically, the two supports 21 are in a non-parallel arrangement, and the two supports 21 define a narrow opening 23 and a wide opening 24 in a direction perpendicular to the height direction 4; however, in an alternative embodiment, the two supports 21 are in a parallel arrangement. A point at which the swingable member 321 and the base 31 are rotatably connected to each other is closer to the wide opening 24 than a point at which the back 361 and the base 31 are rotatably connected to each other, the adjustable weight unit 1 is adjacent to the narrow opening 23, and the seat 362 is protrusive beyond the wide opening 24.

Preferably, the grip 322 includes a first member 323 and two second members 324, the first member 323 is rotatably connected to the swingable member 321, and the two second members 324 are respectively connected to two sides of the first member 323 and configured for hand gripping . . . .

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An exercise device including:

an adjustable weight unit;

a first training mechanism including two supports, a plurality of first rollers, two first cables and two pulling assemblies, the two supports defining an internal space, the two supports defining a height direction, each respective pulling assembly of the two pulling assemblies being disposed on a respective support of the two supports and movable in the height direction, the plurality of first rollers being disposed on the two supports, the two first cables being respectively disposed around the plurality of first rollers, and connected to the adjustable weight unit and the two pulling assemblies so that the two pulling assemblies and the adjustable weight unit are movable with each other; and a second training mechanism joined with the first training mechanism and including a base, a swingable assembly, a plurality of second rollers and a second cable, the base being received in the internal space, the swingable assembly being disposed on the base, the plurality of second rollers being disposed on the base, the second cable being disposed around the plurality of second rollers and connected to the adjustable weight unit and the swingable assembly;

wherein the swingable assembly includes a swingable member and a grip, the swingable member is disposed on the base and connected to the second cable, and the grip is adjustably positioned to the swingable member, wherein the swingable assembly further includes a positioning mechanism, the positioning mechanism includes a first positioning mechanism and a plurality of positioning holes, one of the first positioning mechanism and the plurality of positioning holes is disposed on the grip, the other of the first positioning mechanism and the plurality of positioning holes is disposed on the swingable member, and the first positioning mechanism is selectively inserted in one of the plurality of positioning holes.

2. The exercise device of claim 1, wherein the second training mechanism further includes a seating portion which is replaceable.

3. The exercise device of claim 2, wherein the seating portion includes a back and a seat, the back is positioned to the base, and the seat is disposed on and protrusive from the base.

4. The exercise device of claim 3, wherein the two supports are located on opposing sides of the base; the positioning mechanism further includes a first adjustment disc, the first adjustment disc is disposed on the swingable member and includes the plurality of positioning holes, and the plurality of positioning holes are arranged in intervals in a arced arrangement; the grip includes a first member and two second members, the first member is rotatably connected to the swingable member, and the two second members are respectively connected to two sides of the first member and configured for hand gripping; the two supports are in a non-parallel arrangement; the two supports define a narrow opening and a wide opening located in a direction perpendicular to the height direction, a point at which the swingable member and the base are rotatably connected to each other is closer to the wide opening than a point at which the back and the base are rotatably connected to each other, the adjustable weight unit is adjacent to the narrow opening, and the seat is protrusive beyond the wide opening; an end of the grip is positioned to a right end of the first adjustment disc; an end of the grip is positioned to a left end of the first adjustment disc; the first positioning mechanism includes a tubular portion, an elastic member and a pin, the tubular portion is positioned to the grip, the pin is movably disposed through the tubular portion, the elastic member is disposed between an inner surface of the tubular portion and the pin, and the pin is biased by the elastic member, protrusive out beyond the tubular portion and inserted in one of the plurality of positioning holes; the seating portion further includes a second adjustment disc and a second positioning mechanism, the second adjustment disc is disposed on and movable with the back, the second adjustment disc includes a plurality of insertion holes, and the second positioning mechanism is disposed on the base and selectively inserted in one of the plurality of insertion holes to position the back; the second positioning mechanism is identical to the first positioning mechanism.

5. The exercise device of claim 1, wherein the adjustable weight unit is located in the internal space and disposed on the base.

6. The exercise device of claim 1, wherein the two supports are located on opposing sides of the base.

7. The exercise device of claim 1, wherein the positioning mechanism further includes a first adjustment disc, the first adjustment disc is disposed on the swingable member and includes the plurality of positioning holes, and the plurality of positioning holes are arranged in intervals in an arced arrangement.

* * * * *